US005237716A

United States Patent [19]

Lisec

[11] Patent Number: 5,237,716

[45] Date of Patent: Aug. 24, 1993

[54] DEVICE FOR CLEANING PROFILED SECTIONS

[76] Inventor: Peter Lisec, Bahnhofstrasse 34, A-3363 Amstetten-Hausmening, Austria

[21] Appl. No.: 890,132

[22] Filed: May 29, 1992

[30] Foreign Application Priority Data

Jun. 12, 1991 [AT] Austria ..... 1182/91

[51] Int. Cl.[5] ..... A46B 13/02

[52] U.S. Cl. ..... 15/77; 15/88.3; 15/181

[58] Field of Search ..... 15/55, 77, 88, 88.2, 15/88.3, 179, 181, 88.4

[56] References Cited

U.S. PATENT DOCUMENTS

| | | | |
|---|---|---|---|
| 500,219 | 6/1893 | Sague | 15/77 |
| 634,325 | 10/1899 | Chain | 15/88.3 |
| 755,937 | 3/1904 | Richardson et al. | 15/88.2 |
| 805,763 | 11/1905 | Tuttle | 15/179 |
| 1,106,492 | 8/1914 | Case | 15/77 |
| 1,684,896 | 9/1928 | Stebler | 15/88.3 |
| 1,691,399 | 11/1928 | Lormor | 15/88.3 |
| 1,853,078 | 4/1932 | Phelps et al. | 15/88.3 |
| 2,178,185 | 10/1939 | Nicholson | 15/88.3 |
| 2,334,714 | 11/1943 | Knight | 15/88.3 |
| 2,467,194 | 4/1949 | Dewitt | 15/77 |
| 4,139,921 | 2/1979 | Kline et al. | 15/88.4 |

FOREIGN PATENT DOCUMENTS

| | | | |
|---|---|---|---|
| 712 | 7/1899 | Austria | 15/88.2 |
| 437785 | 11/1926 | Fed. Rep. of Germany | 15/77 |
| 1167791 | 5/1964 | Fed. Rep. of Germany | 15/181 |
| 2270413 | 12/1975 | France | 15/77 |
| 7702698 | 9/1978 | Netherlands | 15/77 |
| WO86/07292 | 12/1986 | PCT Int'l Appl. . | |
| 660203 | 4/1979 | U.S.S.R. | 15/88.4 |
| 1248763 | 8/1986 | U.S.S.R. . | |
| 1602440 | 10/1990 | U.S.S.R. | 15/88.4 |
| 2194135 | 3/1988 | United Kingdom . | |
| 2229376 | 9/1990 | United Kingdom . | |

*Primary Examiner*—Harvey C. Hornsby
*Assistant Examiner*—Mark Spisich
*Attorney, Agent, or Firm*—Young & Thompson

[57] ABSTRACT

A device for cleaning U-profile sections (2) comprises a brush roll (8), engaging the base of the section from the outside and provided with bristles (14) oriented perpendicularly to the axis of rotation of the roll, and two further brush rolls (4, 5) with bristles (20, 27) forming an acute angle ($\alpha$) with the axis of rotation (24, 26) of the brush rolls (4, 5). The brush rolls (4, 5) with bristles (20, 27) inclined in opposite directions with respect to their axes of rotation (24, 26) are arranged in series, based on the direction of movement (arrow 3) of the profiled section (2) through the device.

9 Claims, 3 Drawing Sheets

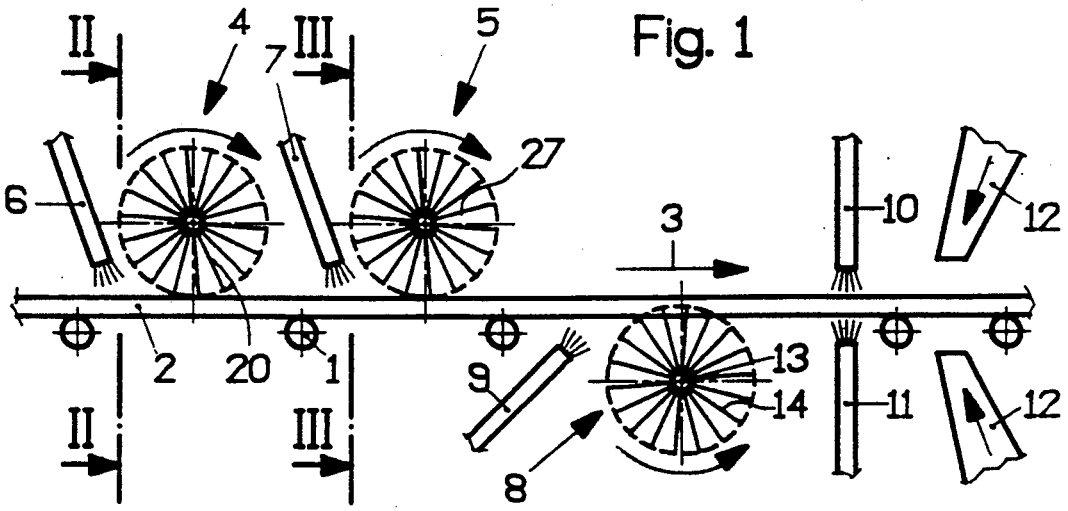
Fig. 1
Fig. 2
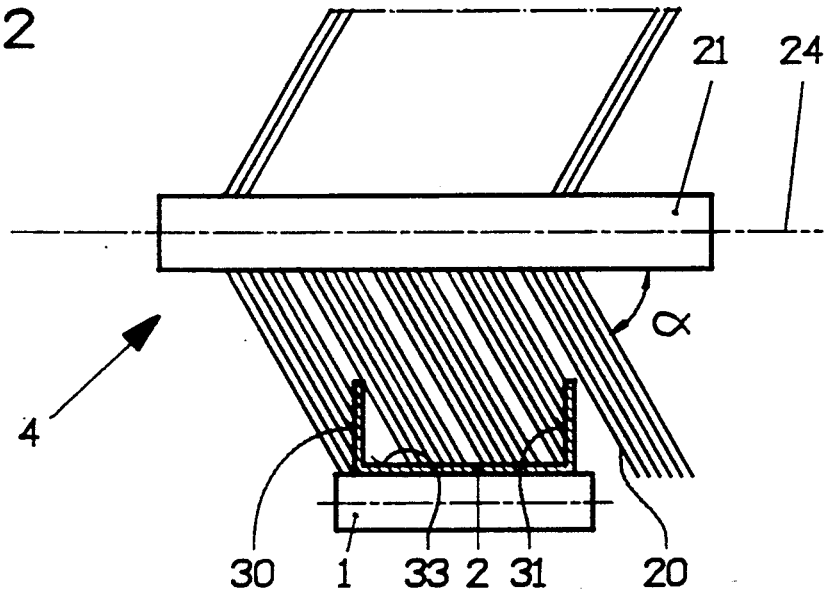
Fig. 3
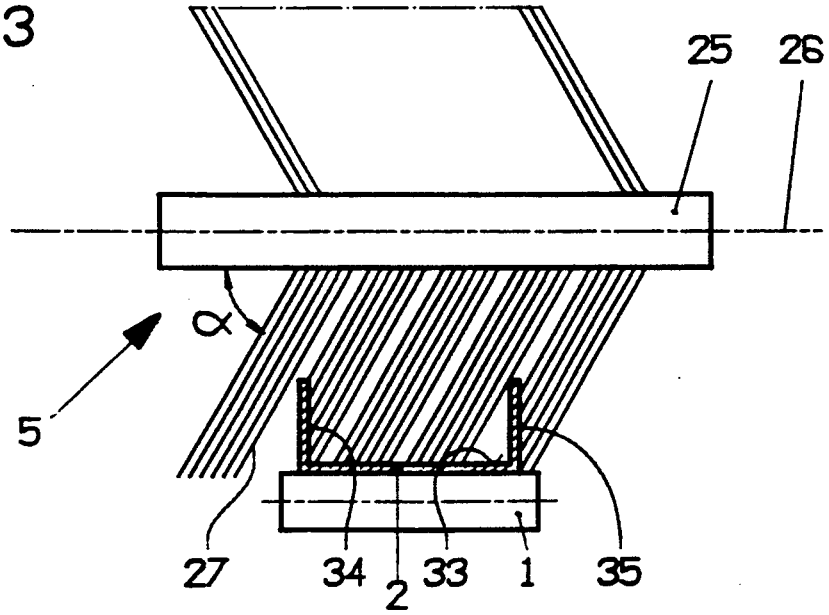

DEVICE FOR CLEANING PROFILED SECTIONS

The invention relates to a device for cleaning profiled sections angled at least once by means of rotationally driven brush rolls. Optionally, this device is also equipped with means for feeding cleaning fluid to the brush rolls and/or to the profiled section to be cleaned, with a rinsing unit, and with nozzles for drying the thus-cleaned profiled sections.

It has been known heretofore to utilize, for the cleaning of profiled sections such as, for example, U-profile sections, L-profile sections, or the like, brush rolls exhibiting bristles or bristle clusters oriented perpendicularly to the axis of rotation. It is necessary in these conventional devices to provide brush rolls located above and below the profiled section to be cleaned, as well as to arrange additional brush rolls rotatable about axes aligned perpendicularly to the aforementioned brush rolls, these latter brush rolls engaging the legs of the U profiles from the inside and from the outside.

On account of the large number of brush rolls required for processing (cleaning) the entire surface area of the profiled section to be cleaned, the conventional devices are comparatively expensive.

Russian Patent 1,248,763 shows and discloses a pot-type brush, the bristles of which are combined into individual clusters, spacings being present between the bristle clusters intended for penetrating into recesses extending transversely to the longitudinal extension of a workpiece, for example between teeth of the latter, and for becoming effective therein. This brush known from Russian Patent 1,248,763 solely comprises one brush roll, the bristles thereof forming an acute angle with the axis of rotation of the brush roll. Aside therefrom, the pot-type brush described in Russian Patent 1,248,763 is not suited for the cleaning of elongated profiles.

British Patent 2,194,135 describes a floor brush with a plate-shaped brush element, assuming a slightly conical shape in the unstressed condition. The surface of the brush element acting on the floor consists of loosely spun polymer fibers which can be attached to a carrier plate by means of a burr-type closure.

British Patent 2,229,376 concerns a device intended for the cleaning of ducts in wastewater treatment facilities. This cleaning apparatus is provided with a brush carrying flexible bristles which latter assume, during operation of the device, the position illustrated in FIG. 1 of British Patent 2,229,376. British Patent 2,229,376 shows a brush with bristles projecting radially from the brush and with bristles projecting, in part, axially, in part, conically from the end face of the brush located oppositely to the side connected to the rotating axle. This brush arrangement known from British Patent 2,229,376 is solely able to clean the inner surfaces of ducts or the like; the entire brush body must be accommodated in the interior of the duct to be cleaned.

WO 86/07292 describes a cleaning apparatus exhibiting several bent wire pieces attached to an elastic carrier. This cleaning device can be, for example, of disk-shaped design and is inserted into the chuck of an electrical drive mechanism. The bent wire pieces are pivotably mounted in the carrier of elastic material so that they can be righted during operation of the device.

The invention is based on the object of indicating a device of the type discussed hereinabove which is of a simpler structure and can make do with less brush rolls, yet permitting a reliable cleaning of all surfaces of the profiled section.

This object has been attained in accordance with this invention by providing that at least two of the brush rolls exhibit bristles or bristle clusters forming an acute angle with the axis of rotation of the brush roll, wherein the bristles or bristle clusters of the two brush rolls are inclined mutually into opposite directions.

Since, in the device according to this invention, brush rolls are provided with bristles or bristle clusters that are inclined into opposed directions, the areas of the profiled sections oriented perpendicularly to the axis of rotation of the brush rolls are likewise reliably cleaned thereby. On account of the fact that the bristles or bristle clusters of the brush rolls are inclined alternatingly into opposite directions, the insides as well as the outsides of the zones of the profiled sections oriented perpendicularly to the axis of rotation are reliably cleaned.

However, the device of this invention reliably cleans not only the zones of the profiled sections oriented perpendicularly to the axes of rotation of the brush rolls, but also the zones of the profiled sections facing the brush rolls and in parallel to their axes of rotation so that all of the surfaces of the profiled section facing the brush rolls can be cleaned, no matter whether these surfaces are oriented perpendicularly or in parallel to the axis of rotation of the brush rolls.

If it is desired to clean also the regions of the profiled sections facing away from the brush rolls, then it is possible to provide additionally a brush roll studded with bristles or bristle aligned perpendicularly to the axis of rotation of brush roll.

In one embodiment of the invention the provision can be made that the zones of the brush rolls studded with obliquely oriented bristles or bristle clusters are arranged to be mutually offset. This version has the advantage, for example, when cleaning U-shaped profiles that the bristle clusters or bristles are worn down to a lesser extent since no bristles are present in the zone of the leg of the profile that is not being cleaned at that time. In order to still ensure a reliable cleaning even of the zone of the leg of the U-shaped profile lying between the bases, the provision can be made that the zones studded with obliquely oriented bristles overlap one another.

BRIEF DESCRIPTION OF THE DRAWINGS

Further details, features and advantages of the invention can be seen from the follow description, reference being had to the drawings wherein:

FIG. 1 shows a device for cleaning profiled sections in a lateral view,

FIG. 2 shows a section along II—II in FIG. 1,

FIG. 3 shows a section along line III—III in FIG. 1,

DETAILED DESCRIPTION OF THE INVENTION

Figure 4:
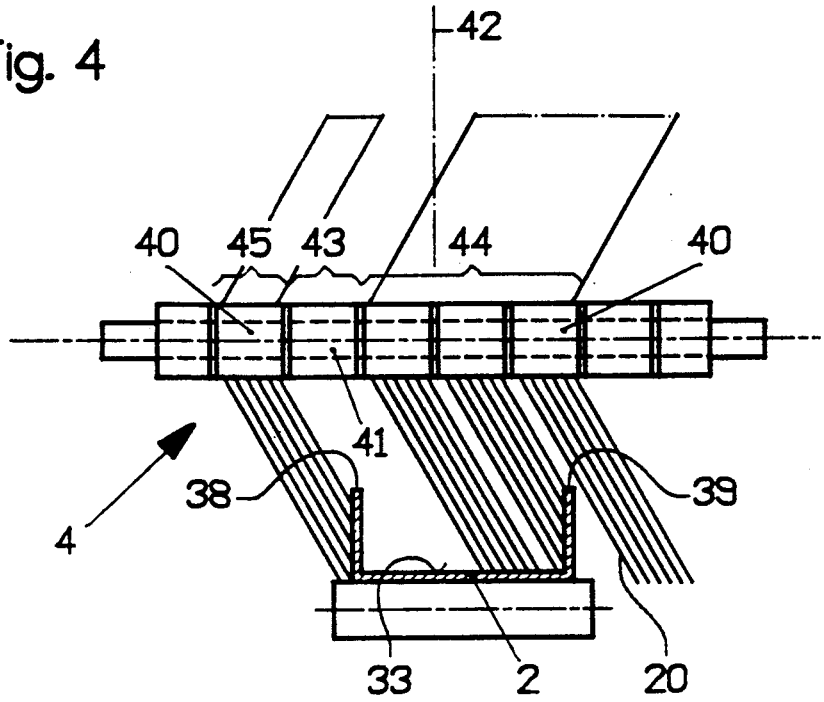
FIGS. 4 and 5 show, in illustrations analogous to those of FIGS. 2 and 3, a modified embodiment.

A device for cleaning profiled sections 2 that are angled at least once, as shown in FIG. 1—a U-profile section being cleaned in the illustrated embodiment—comprises a horizontal conveyor consisting of conveying rollers 1 or similar conveying means moving the profiled section 2 to be cleaned through the device in the direction of arrow 3. Above the conveying rollers 1, two brush rolls 4 and 5 are arranged which are rotatably mounted in a machine frame, not shown, and are coupled with a drive mechanism. Each of the two brush rolls 4 and 5 is associated with spraying units 6 and 7, respectively, for cleaning medium. These spraying units 6 and 7 spray cleaning medium onto the brush rolls 4 and 5 and/or the profiled section 2.

Following the brush rolls 4 and 5, a further brush roll 8, rotationally driven about an axis 13 perpendicular to the conveying direction 3, is arranged and engages on the side of the profile 2 oppositely to the brush rolls 4 and 5. The brush roll 8 likewise is associated with a spraying unit 9 for cleaning medium.

Following the brush rolls 4, 5 and 8, also a rinsing unit 10, 11 is provided in the illustrated embodiment, for example nozzles from which a rinsing fluid is applied to the profiled section 2 in order to rinse the latter off, and subsequently to this rinsing unit, a device 12 for drying purposes is arranged. The drying unit 12 can be, for example, a nozzle array supplied with compressed air.

It can be seen from the sectional view of FIG. 2 that the bristles or bristle clusters 20 of the brush roll 4 are inserted in the core 21 of the brush roll 4 inclined under an acute angle $\alpha$ with respect to the axis of rotation 24 of the brush roll 4. Thereby, the brush roll 4 cleans the surfaces, denoted in FIG. 2 by 30 and 31, respectively, of the two legs of the U profile 2, and a portion of the inner surface 33 of the base of the U-profile section 2.

The brush roll 5 likewise has bristles or bristle clusters 27 inclined at an acute angle $\alpha$ with respect to its core 25 and/or its axis of rotation 26, but the bristle clusters 27 are inclined into the other direction as compared with the bristle clusters or bristles 20 of the brush roll 4. Thereby, the bristles or bristle clusters 27 of the brush roll 5 clean the surface areas of the legs of the U-profile section 2 denoted by 34 and 35 in FIG. 3, and the other region of the inner surface 33 of the base of the U profile 2.

The brush roll 8 engaging at the underside of the U-profile section, i.e. on the outer surface facing the conveying rollers 1, can have, as is conventional, bristles or bristle clusters 14 oriented perpendicularly to its brush core 13.

It can be seen that, due to the special structure of the brush rolls 4 and 5 with only two brush rolls, all of the surfaces of the U-profile section 2 facing these rolls are cleaned, no matter whether these are oriented in parallel or perpendicularly to the axis of rotation 24 or 26 of the brush rolls 4 and 5.

Figure 5:
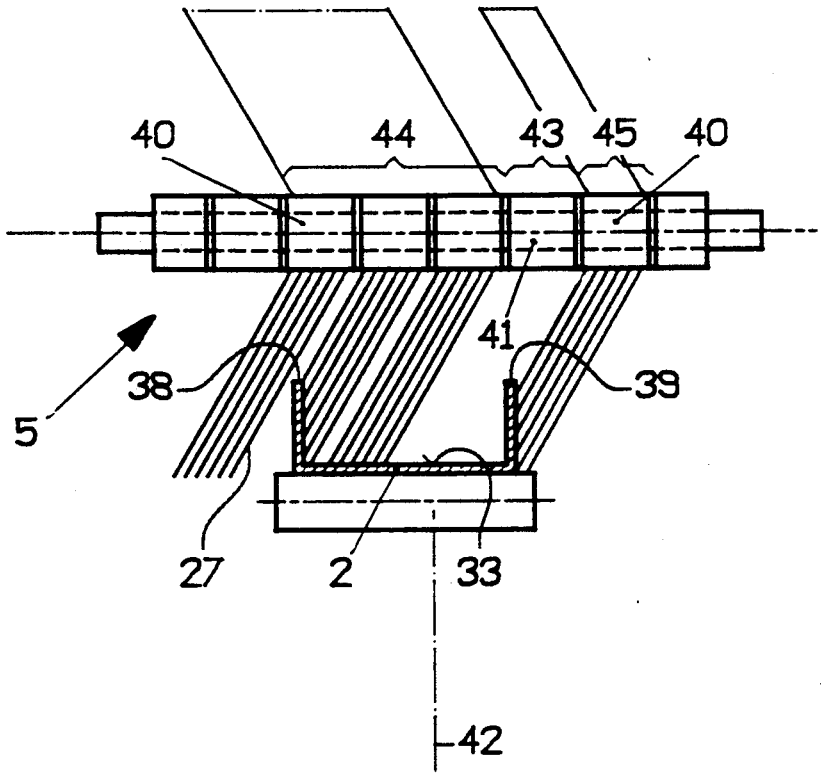

In order to prevent the bristles or bristle clusters 20 or 27 of the brush rolls 4 and 5 from rubbing along the free rim 38 or 39 of the leg of the U-profile section 2 which is not being cleaned at that time and thus from being exposed to increased wear, the regions 44, 45 of the brush rolls 4 and 5, respectively, studded with bristle or bristle clusters 20 and 27, respectively, can be arranged as illustrated in FIGS. 4 and 5. It can be seen that the bristle equipment of the brush rolls 4 and 5 is arranged, based on the conveying direction, to be mutually offset and that the interruption 43 in the bristle studding is located, for example, one time on one side and then on the other side of the longitudinal plane of symmetry 42 of the device. Suitably, the zones 44 wherein the brush rolls 4 and 5 are studded with bristles or bristle clusters 20 or 27 overlap each other a little so that the surface 33 of the profile 2 is reliably cleaned. It can be seen that, in this embodiment, the outsides of the legs of the U-profile section 2 are acted on by the bristles or bristle clusters 20 or 27 located in zone 45 so that also in this version all of the outer surface areas of the profiled section 2 are cleaned.

In case no bristle equipment is provided in the zone 45 of the brush rolls 4 and 5, it is possible to include brush rolls, rotating perpendicularly to the axis of rotation 24 or 26, with bristles or bristle clusters projecting perpendicularly to their axes of rotation.

In order to adapt the position of the zone 43 not studded with bristles or bristle clusters 20 or 27 to the width of the profiled section 2 to be cleaned (so that one leg will be located with its rim 38 or 39 within this region 43), the brush roll or one or both of the studded zones 44, 45 can be adjustable in the direction of the axis of rotation of the brush rolls 4 and 5.

The brush rolls 4, 5 can also be adapted to differing profiles or profile sizes by placing sleeves 40 carrying the bristles or bristle clusters 20, 27 onto the shafts 21, 25 of the brush rolls 4, 5. The sleeves 40 are connected for rotation with the shafts 21, 25, for example by means of tongue-and-groove couplings, and can be fixedly arranged on the shafts 21, 25 in the axial direction by end disks or end caps (not shown). In case zones 43 of the brush rolls 4, 5 are to be present which are not studded with bristles or bristle clusters 20, 27, then bare sleeves 41 can be pushed onto the shafts 21, 25 at those locations where no bristles or bristle clusters 20, 27 are to be provided.

Figure 6:
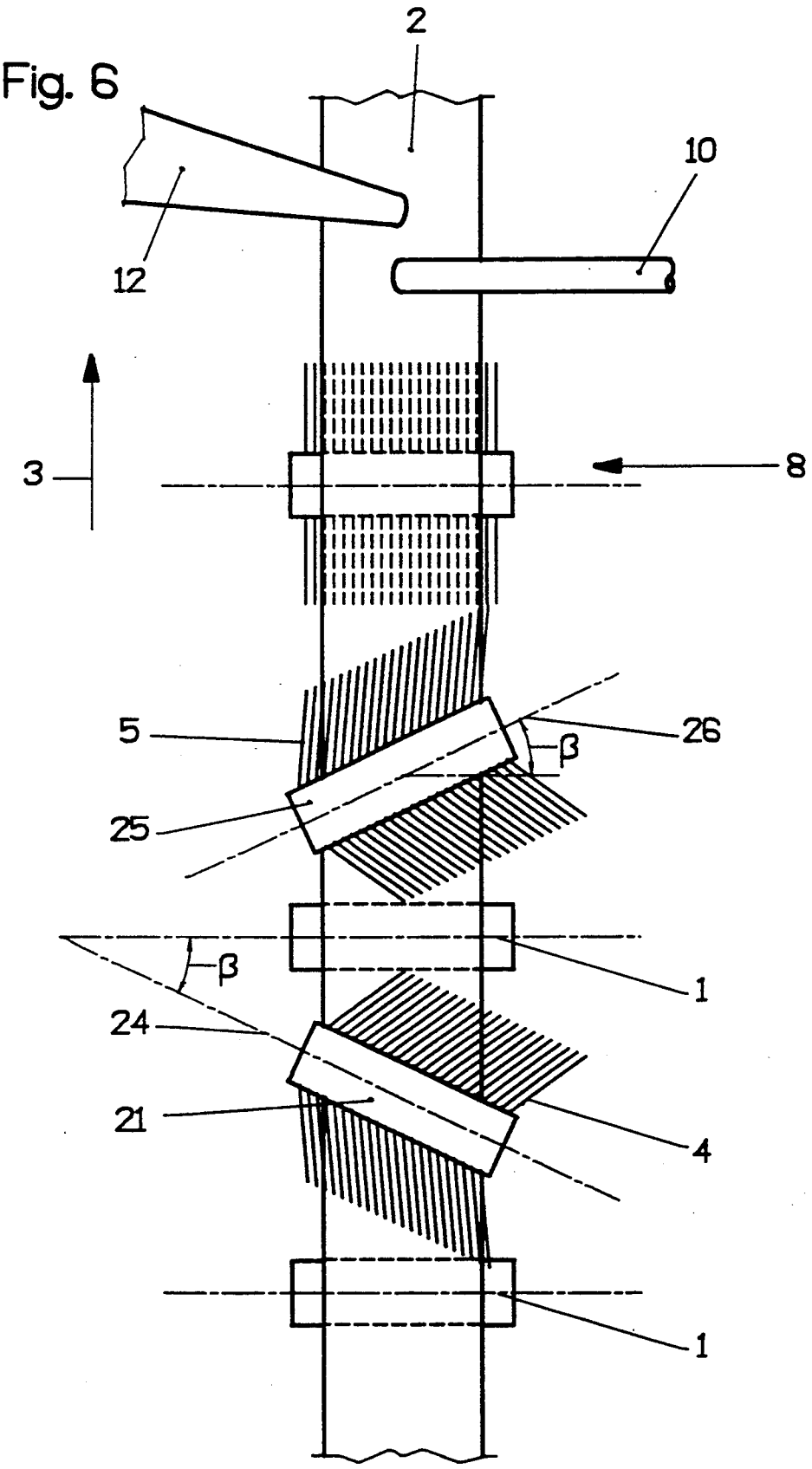
FIG. 6 shows an embodiment with obliquely oriented brushes.

The embodiment shown in a top view in FIG. 6 corresponds essentially to the embodiment of FIG. 1, but the axes 24, 26 of the brush rolls 4 and 5 are oriented obliquely to the conveying direction (arrow 3) and, respectively, to the longitudinal extension of the profile 2. In this arrangement, the oblique positioning (angle $\beta$) of the axes 24 and 26—these are inclined in mutual opposition—corresponds approximately to the angle $\alpha$ with which the bristles or bristle clusters 20 or 27 are inclined with respect to the axes of rotation 24 and 26, respectively. It is having the structure shown in FIGS. 4 and 5 for the embodiment illustrated in FIG. 6.

The device according to this invention can be utilized for a great variety of configurations of profiled strips which are of an at least once angled design. Also, profiled strips of any desired materials, for example also those of glass or metal (steel) can be cleaned by means of the device according to the present invention.

In order to avoid nonuniform wearing of the bristles or bristle clusters 20 or 27 along the legs of the U-profile section to be cleaned, especially on the free rims 38 and 39, respectively, of the legs, the brushes 4 and/or 5 are slowly moved to and fro in the direction of their axes 24, 26 (transversely to the feeding direction [arrow 3] of the profile 2 to be cleaned). Thus, bristles or bristle clusters over a wide region of the brushes 4 and/or 5 will enter the zone of the legs of the profiled section 2, and wearing of the bristles or bristle clusters 20 will become more uniform. For moving the brushes 4 and/or 5 in the direction of their axes 24 and 26, respectively, it is possible to provide linear motors (pressure medium motors or the like), engaging their shafts 21 and 25; these motors are dual-acting or, if they are of the single-drive variety only, operate against springs stressing the shafts 21 and 25 of the brushes 4 and/or 5 in one direction.

In summation, the invention can be represented, for example, as follows:

A device for cleaning U-profile sections 2 comprises a brush roll 8, engaging the base from the outside and provided with bristles 14 oriented perpendicularly to the axis of rotation of the roll, and two further brush rolls 4, 5 with bristles 20, 27 forming an acute angle ($\alpha$) with the axis of rotation 24, 26 of the brush rolls 4, 5. The brush rolls 4, 5 with bristles 20, 27 inclined into opposite directions with respect to their axes of rotation 24, 26 are arranged in series, based on the direction of movement (arrow 3) of the profiled section 2 through the device.

What is claimed is:

1. Device for cleaning elongated profiled sections that are angled at least once, comprising means conveying said elongated sections in a lengthwise direction of movement, plural rotary brushes disposed to contact a same side of said sections, said brushes having bristles that engage said sections to clean said sections, said brushes being spaced apart along said direction of movement, each said brush rotating about a respective axis of rotation disposed transverse to said direction of movement, said bristles being disposed at acute angles to their respective axes of rotation, the bristles of one brush being inclined relative to its respective axis of rotation in a direction opposite to the bristles of another said brush.

2. A device as claimed in claim 1, and a further rotary brush rotatable about an axis of rotation disposed to contact the side of said sections opposite the first-mentioned brushes, said further brush having bristles perpendicular to its axis of rotation and engaging the profiled section.

3. A device as claimed in claim 1, wherein said bristles of each brush are arranged in groups that are spaced apart axially of the brush, the groups of said one brush being offset, as seen in said one direction, from the groups of said another brush.

4. A device as claimed in claim 1, and means for adjusting the bristles of each brush in a direction parallel to the axis of rotation of the brush.

5. A device as claimed in claim 1, wherein each brush comprises a shaft and a plurality of sleeves fixedly mounted on the shaft, the bristles being mounted on the sleeves.

6. A device as claimed in claim 5, there being a said sleeve without bristles arranged between two sleeves provided with bristles.

7. A device as claimed in claim 1, the axis of rotation of at least one said brush being inclined at a second acute angle to said direction of movement.

8. A device as claimed in claim 7, wherein the axes of rotation of the brushes are inclined relative to said direction of movement at equal but opposite angles.

9. A device as claimed in claim 7, wherein said second acute angle is substantially equal to the acute angle formed by the bristles of said at least one brush and its respective axis of rotation.

* * * * *